US008682206B2

(12) United States Patent
Iwasaki

(10) Patent No.: US 8,682,206 B2
(45) Date of Patent: Mar. 25, 2014

(54) SUSPENDED PARTICLE COLLECTING MEMBER AND IMAGE FORMING APPARATUS INCLUDING THE SAME

(75) Inventor: Atsushi Iwasaki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 285 days.

(21) Appl. No.: 13/304,192

(22) Filed: Nov. 23, 2011

(65) Prior Publication Data

US 2012/0141173 A1 Jun. 7, 2012

(30) Foreign Application Priority Data

Dec. 2, 2010 (JP) ..... 2010-269737

(51) Int. Cl.
*G03G 21/00* (2006.01)
*G03G 21/20* (2006.01)
*G03G 15/01* (2006.01)

(52) U.S. Cl.
USPC ..... 399/98; 399/92; 399/327

(58) Field of Classification Search
USPC ..... 399/92, 98, 327, 355
See application file for complete search history.

(56) References Cited

U.S. PATENT DOCUMENTS

2008/0219693 A1* 9/2008 Kondo et al. ..... 399/92
2009/0016764 A1* 1/2009 Kitozaki ..... 399/92
2010/0086326 A1* 4/2010 Kitozaki ..... 399/92

FOREIGN PATENT DOCUMENTS

| | | | |
|---|---|---|---|
| JP | 8-87202 | A | 4/1996 |
| JP | 9-34283 | A | 2/1997 |
| JP | 11-184293 | A | 7/1999 |
| JP | 2001-249562 | A | 9/2001 |
| JP | 2004-354443 | A | 12/2004 |
| JP | 2005-70264 | A | 3/2005 |
| JP | 2006-220791 | A | 8/2006 |
| JP | 2006-330480 | A | 12/2006 |
| JP | 2006-349826 | A | 12/2006 |
| JP | 2007-79184 | A | 3/2007 |
| JP | 2007-86509 | A | 4/2007 |
| JP | 2007-171921 | A | 7/2007 |

* cited by examiner

*Primary Examiner* — Walter L Lindsay, Jr.
*Assistant Examiner* — Rodney Bonnette
(74) *Attorney, Agent, or Firm* — Canon USA Inc. IP Division

(57) ABSTRACT

A collecting member that collects suspended particles vaporized from wax includes a flow path and a space, where gas passes along the flow path. The space is connected to the flow path through an opening formed in the flow path. The space extends upstream with respect to a direction of travel of the gas that passes along the flow path. By virtue of this structure, dew condensation in a fixing unit is suppressed while efficiently collecting the suspended particles.

7 Claims, 11 Drawing Sheets

(SIDE OF FIXING ROLLER 101)

SUSPENDED PARTICLE COLLECTING MEMBER AND IMAGE FORMING APPARATUS INCLUDING THE SAME

BACKGROUND OF THE INVENTION

1. Field of the Invention

The present invention relates to a suspended particle collecting member that becomes suitable when the suspended particle collecting member is installed in an image forming apparatus (such as a copying machine or a printer using electrophotographic recording technology), and to an image forming apparatus including the suspended particle collecting member.

2. Description of the Related Art

In general electrophotographic image forming apparatuses, a fixing unit heats a toner image formed on a recording material, and fixes the toner image to the recording material. Many types of toner materials contain wax components in addition to charging controlling agents, coloring agents, or binder resins (such as polyester resin or polystyrene resin). The wax components have various roles. The wax components serve as adjusting agents that adjust the melting temperature and the viscosity of toner. They also serve as adjusting agents that adjust the glossiness of a print image. They further serve as release agents for preventing offset development in which a portion of fused toner is moved to the surface of a fixing roller instead of to the recording material.

The wax components added to the toner are liquefied when the fixing unit is fixing the toner image, and large quantities of the wax components are, along with the fused toner, fixed after being transferred to the recording material. However, quantities of the wax components are vaporized. The vaporized wax components become liquid or solid fine particles depending on the ambient temperature during suspension thereof, and the fine particles are scattered. The fine particles are moved out of the fixing unit along rising air currents that are generated by the heat of the fixing unit and along air currents that are generated by the recording material that is conveyed.

When fixing temperature increases as the speed of the image forming apparatus increases, larger quantities of the wax components are vaporized. The wax components that are moved out of the fixing unit may adhere to various locations in the image forming apparatus. For example, when the wax components adhere to a conveying roller or a conveying guide for conveying the recording material, the wax components prevent the conveyance of the recording material and reduce the coefficient of friction of the conveying roller. Therefore, it is necessary to suppress leakage of the wax components to the vicinity of the fixing unit.

In a fixing unit disclosed in Japanese Patent Laid-Open No. 11-184293, the following technology is discussed. That is, an air blocking member that blocks the flow of air is provided in a gap (provided between a fixing rotating member and an inner wall of a housing), so that the flow of air in the housing is suppressed, and leakage of vaporized release agent is prevented from occurring. It is possible to filter suspended particles by disposing, for example, a nonwoven filter or an activated carbon filter in, for example, an exhaust duct disposed between the vicinity of the fixing unit and a location that is outside of the fixing unit. However, when an air blocking member is provided as mentioned above, although the vaporized release agent leaks out from the fixing unit less often, water vapor that is generated from the heated recording material tends to accumulate in the fixing unit, as a result of which dew condensation tends to occur in the fixing unit.

Therefore, further measures need to be taken to prevent, for example, adhesion of water droplets to the recording material, a conveying member, etc. Even in the case where, for example, the aforementioned nonwoven filter is used, air in the vicinity of the fixing unit similarly generally tends to accumulate. Therefore, it is necessary to take measures against, for example, a temperature rise in the image forming apparatus in addition to dew condensation.

SUMMARY OF THE INVENTION

The present invention makes it possible to increase the quality and reliability of an image forming apparatus by suppressing dew condensation (caused by water vapor from, for example, a recording material), while efficiently collecting suspended particles, such as wax components, that are generated in an image forming process in the image forming apparatus.

According to an aspect of the present invention, there is provided an image forming apparatus including an image forming section configured to form a toner image on a recording material using toner containing wax, a fixing section configured to fix the toner image to the recording material by heating the toner image, and a suspended particle collecting member configured to collect suspended particles that are components generated from the wax when the toner is heated at the fixing section. The suspended particle collecting member has a flow path, an opening, and a space, where gas containing the suspended particles passes along the flow path. The opening is provided in the flow path. The space is connected to the flow path through the opening, extends upstream with respect to a direction of travel of the gas that passes along the flow path. The opening is formed by a wall.

According to another aspect of the present invention, there is provided a suspended particle collecting member including a flow path along which gas containing suspended particles pass, an opening that is formed in the flow path, and a space that is connected to the flow path through the opening. The space extends upstream with respect to a direction of travel of the gas that passes along the flow path. The space is formed by a wall.

Further features of the present invention will become apparent from the following description of exemplary embodiments with reference to the attached drawings.

DESCRIPTION OF THE EMBODIMENTS

First Exemplary Embodiment

Exemplary embodiments of the present invention will be described below in detail with reference to the drawings. However, the dimensions, materials, shapes, relative positions, etc., of structural components discussed in the exemplary embodiments may be changed when necessary in accordance with the structure of an apparatus to which the present invention is applied and various conditions. Therefore, they are not meant to limit the scope of the invention to the forms discussed below.

(1) Overall Structure of Image Forming Apparatus

Figure 1:
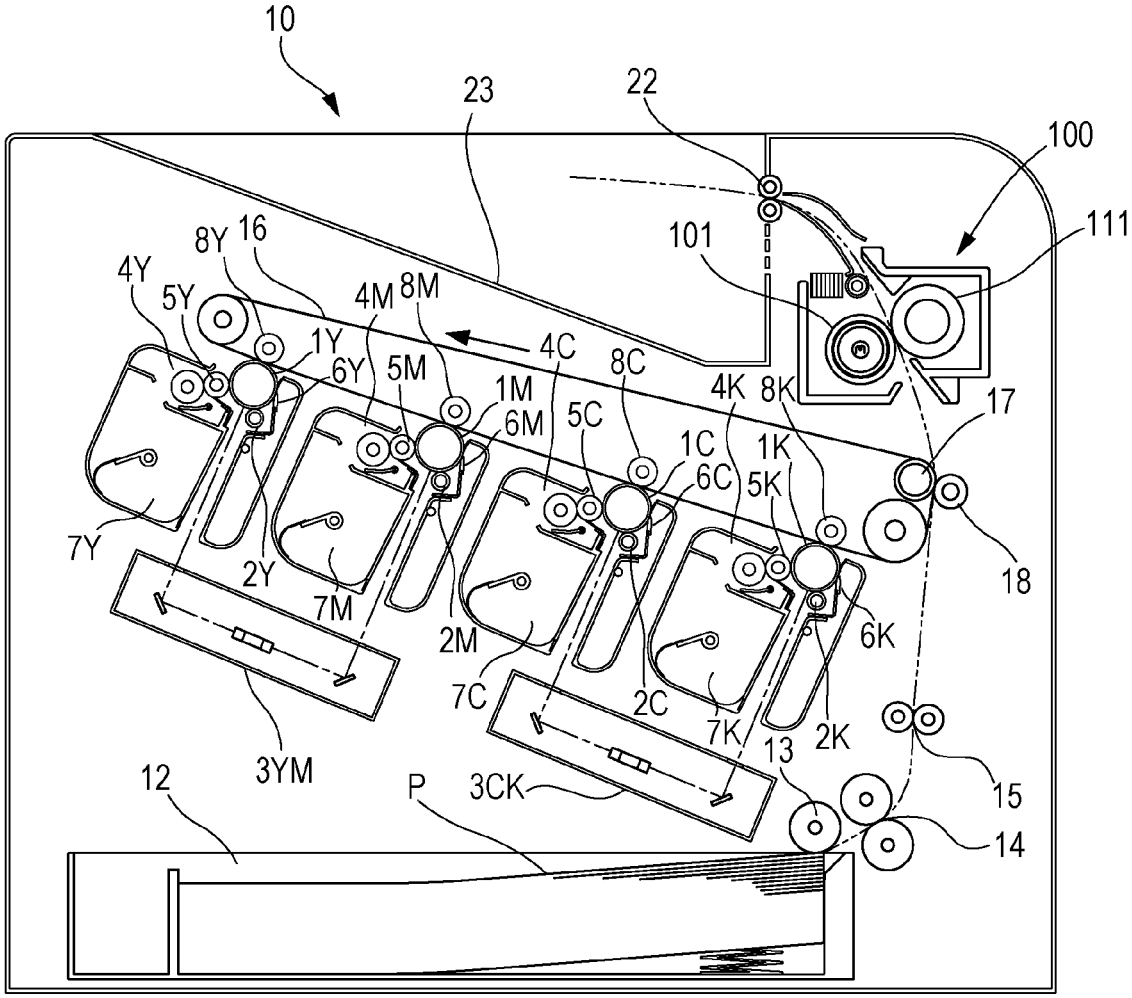
FIG. 1 is a schematic sectional view of an image forming apparatus according to a first exemplary embodiment of the present invention.

First, the overall structure of an image forming apparatus will be described with reference to FIG. 1. FIG. 1 is a schematic sectional view of the overall structure of a full-color laser printer (hereunder referred to as "printer 10") serving as an exemplary image forming apparatus.

The full-color laser beam printer 10, serving as the image forming apparatus according to the exemplary embodiment, will be described. Although, in the exemplary embodiment, the full-color laser beam printer 10 including a plurality of photosensitive drums is used as an example, the present invention is not limited thereto. The present invention is also applicable to a printer or a monochromatic copying machine including one photosensitive drum.

A sheet-feed cassette 12 is provided at a lower portion of the printer 10 so that it can be drawn out. The cassette 12 holds recording materials P that are stacked upon each other. The recording materials P are fed from the sheet-feed cassette 12 by a pickup roller 13. Then, the recording materials P are separated one at a time by a pair of feed/retard rollers 14, so that the separated recording materials P are fed to registration rollers 15. The printer 10 includes four image forming stations (image forming sections 7) 7Y, 7M, 7C, and 7K corresponding to yellow, magenta, cyan, and black.

The photosensitive drums 1Y, 1M, 1C, and 1K (hereunder generally referred to as "photosensitive drums 1"), charging devices 2Y, 2M, 2C, and 2K, developing devices 4Y, 4M, 4C, and 4K, and first transfer sections 8Y, 8M, 8C, and 8K (hereunder generally referred to as "first transfer sections 8") are disposed at the respective image forming sections 7. The charging devices 2Y, 2M, 2C, and 2K uniformly charge the surfaces of the respective photosensitive drums 1. The developing devices 4Y, 4M, 4C, and 4K cause toner to adhere to electrostatic latent images on the photosensitive drums 1 to develop the electrostatic latent images as toner images T. The first transfer sections 8Y, 8M, 8C, and 8K transfer the toner images T on the photosensitive drums 1 to an electrostatic transfer belt 16. Scanner units 3YM and 3CK are disposed below the image forming sections 7. The scanner units 3YM and 3CK irradiate the photosensitive drums 1 with laser beams on the basis of image information to form the electrostatic latent images on the photosensitive drums 1. The toner contains wax. Therefore, the image forming sections form the toner images T on a recording material P using the toner containing wax.

The toner images T on the transfer belt 16 to which the toner images T have been transferred by the first transfer sections 8 are transferred to the recording material P at a second transfer section 18. Then, when the toner images T pass a nip portion N, the toner images T are fixed to the recording material P. The nip portion N is formed by causing a fixing roller 101 and a pressure roller 111 in a fixing unit 100 to press-contact each other. Thereafter, the recording material P is conveyed to a pair of discharge rollers 22. Then, after passing through the pair of discharge rollers 22, the recording material P is discharged to a recording material stacking section 23.

(2) Fixing Unit (Fixing Section)

Next, the fixing unit 100 according to the exemplary embodiment will be described with reference to FIG. 2. Although, in the exemplary embodiment, a heat-roller fixing unit using a pair of rollers is used, the present invention is applicable to an image forming device including other types of fixing units that fix the toner images to the recording material P by heating, such as a film-heating fixing unit using an endless belt (endless film).

Figure 2:
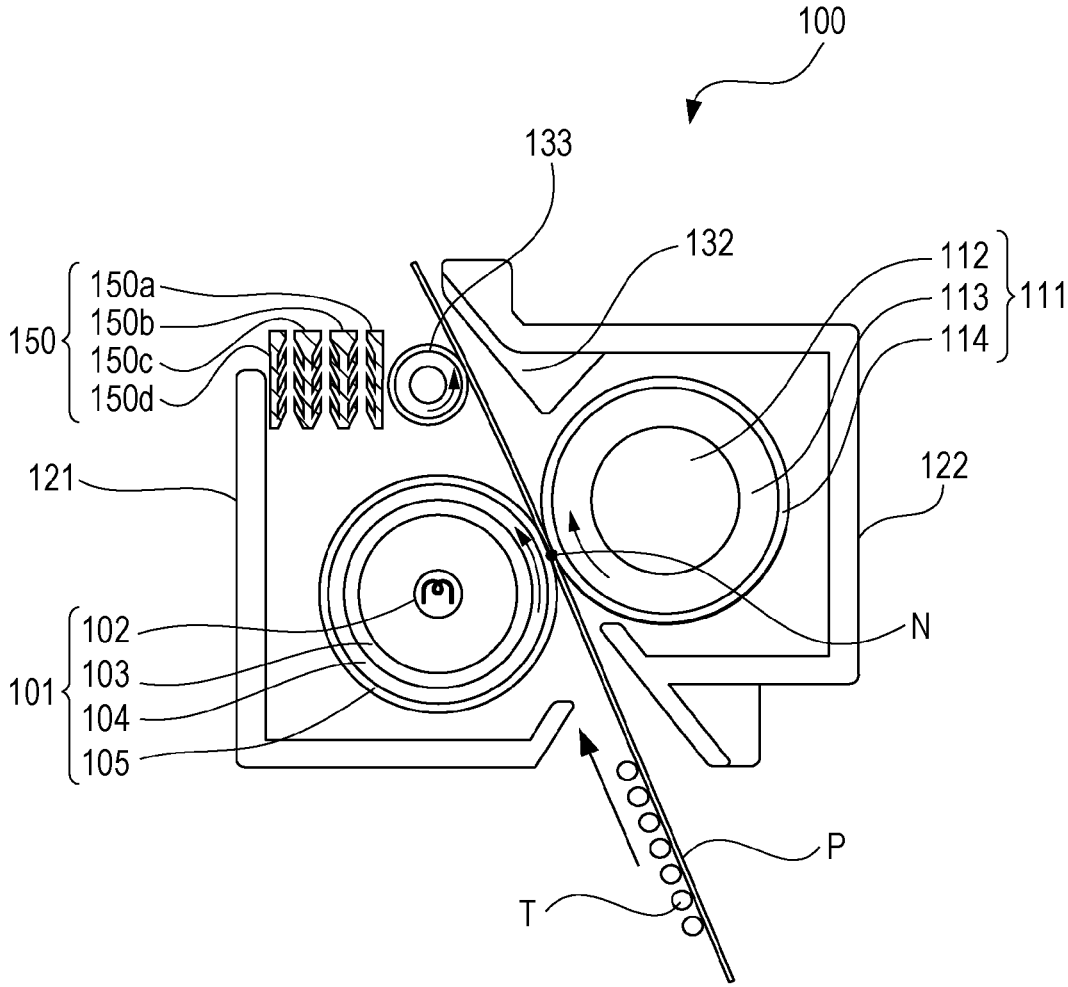
FIG. 2 is a sectional view of a fixing unit including a particle collecting member according to the first exemplary embodiment.

FIG. 2 is a schematic sectional view of the fixing unit 100. As shown in FIG. 2, in the fixing unit 100, the fixing roller 101 and the pressure roller 111, serving as fixing rotating members, are accommodated in respective housings 121 and 122. A pressure unit (not shown) causes the fixing roller 101 and the pressure roller 111 to press-contact each other to form the fixing nip portion N. The pair of the fixing roller 101 and the pressure roller 111 are rotationally driven by a driving unit (not shown). The temperature of the surface of the fixing roller 101 is detected by a temperature detecting element (not shown). A controller controls electric power supplied to a heater 102 so that the detected temperature is maintained at a fixing temperature (control target temperature).

The heater 102, serving as a heat source, such as a halogen heater, is disposed in the fixing roller 101. The fixing roller 101 includes a thin elastic layer 104 and a release layer 105. The elastic layer 104 is formed around the outer side of a hollow core 103. The release layer 105 is formed as an outermost layer, and is formed of, for example, polytetrafluoroethylene (PTFE) or tetrafluoroethylene-perfluoroalkyl vinyl ether copolymer (PFA) having excellent releasing capability. The pressure roller 111 includes an elastic layer 113 and a release layer 114 similar to that of the fixing roller 101. The elastic layer 113 is formed around the outer side of a core 112, and is formed of, for example, silicone rubber. The release layer is formed as an outermost layer.

An exit guide 132 and a conveying guide roller 133 for conveying a recording material P downstream are provided downstream from the fixing nip portion N. As a member including air inlet paths disposed between the fixing unit 100 and the outside of the fixing unit 100, a suspended particle collecting member 150 is disposed in the fixing unit (that is, the fixing section) near an upper portion of the fixing roller 101.

(3) Suspended Particle Collecting Member 150

Figure 3A:
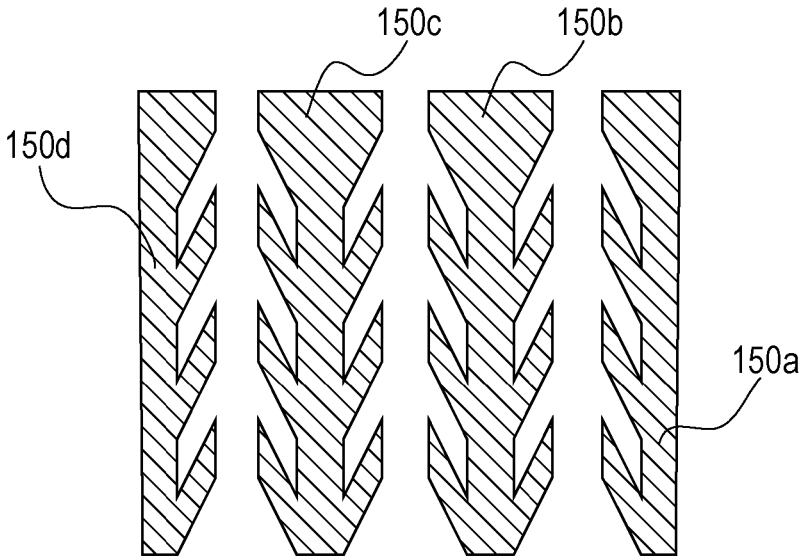
FIGS. 3A and 3B are a vertical sectional view and a perspective view of the particle collecting member according to the first exemplary embodiment.

Next, the suspended particle collecting member (hereunder referred to as "particle collecting member") 150 according to the exemplary embodiment will be described with reference to FIGS. 3A and 3B. FIG. 3A is a vertical sectional view of the particle collecting member 150. The particle collecting member 150 is a structural member including parts 150*a* to 150*d* forming inner walls of the air inlet paths. The lower side in FIG. 3A is a side of the fixing roller 101. The air inlet paths are paths along which gas containing suspended particles (components produced when wax is vaporized) pass.

Figure 3B:
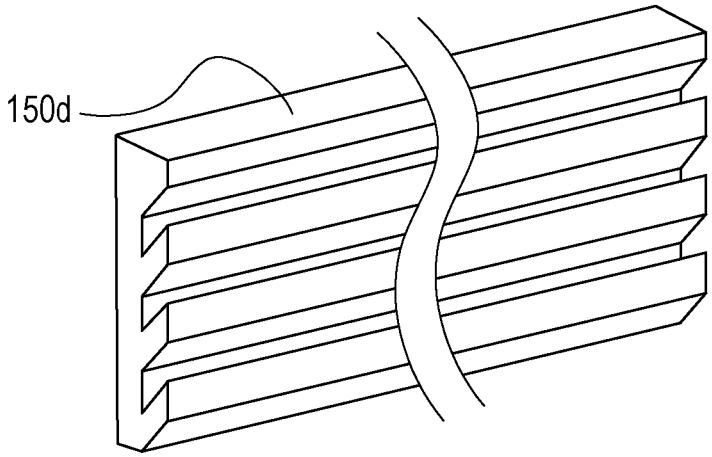

FIG. 3B is a perspective view of the part 150*d* of the particle collecting member 150. In the exemplary embodiment, as shown in FIG. 3B, the cross-sectional shape of the part 150*d* of the particle collecting member 150 is a shape extending in an axial direction (hereunder referred to as "longitudinal direction") of the fixing roller 101. End portions of the part 150*d* in the longitudinal direction are secured by a securing unit (not shown). The parts 150*a* to 150*c* of the particle collecting member 150 have similar longitudinal shapes.

The particle collecting member 150 is formed of a resin material having excellent heat resistance, such as polybutylene terephthalate (PBT), polyethylene terephthalate (PET), polyphenylene sulfide (PPS), or liquid crystal polymer (LCP). The present invention is not limited thereto, so that a material processed with a metal, such as aluminum, may also be used. For example, the particle collecting member 150 may be a particle collecting member whose surface is coated with a heat-resistant resin (such as polyimide), a particle collecting member whose surface has a heat-resistant unwoven cloth attached thereto, or a particle collecting member whose surface has a charging material (such as electret) having electrostatic force provided thereat. That is, the particle collecting member 150 may be formed of any material as long as the material does not prevent adhesion of liquid or solid wax particles.

(4) Mechanism of Collecting Wax Particles or the Like

A mechanism of collecting vaporized particles, such as wax particles, from the fixing roller 101 by using the particle collecting member 150 according to the embodiment will hereunder be described.

First, vaporized particles from the fixing roller 101 will be described in detail with reference to FIG. 2. The following types of vaporized particles are the two main types of vaporized particles. These vaporized particles are generated when a recording material P having toner images T formed thereon pass the fixing nip portion N formed by the fixing roller 101 and the pressure roller 111.

(A) Wax Component

The toner images T that are heated and pressed are softened and fused, so that a release wax component, contained in the toner, and the toner are separated from each other with the release wax component oozing out from an interface between each toner image T and the fixing roller 101. Although a portion of the release wax component temporarily remains at the surface of the fixing roller 101, the portion of the release wax component that temporarily remains at the surface of the fixing roller 101 is vaporized by the heat of the fixing roller 101 in a short time, and merges with the airflow in the vicinity of the fixing roller 101.

(B) Water Vapor

Moisture contained in the recording material P is vaporized from the recording material P by the heat, so that a portion of the moisture merges with the airflow in the vicinity of the fixing roller 101.

Air (gas) containing, for example, the aforementioned vaporized particles flows upward as rising air currents due to thermal expansion of the air along the flow paths formed in the particle collecting member 150, and flows out of the fixing unit 100.

Next, airflow (that is, the flow of air containing vaporized particles such as wax particles and water vapor) along the flow paths formed in the particle collecting member 150 will be described in detail with reference to FIG. 4.

Figure 4:
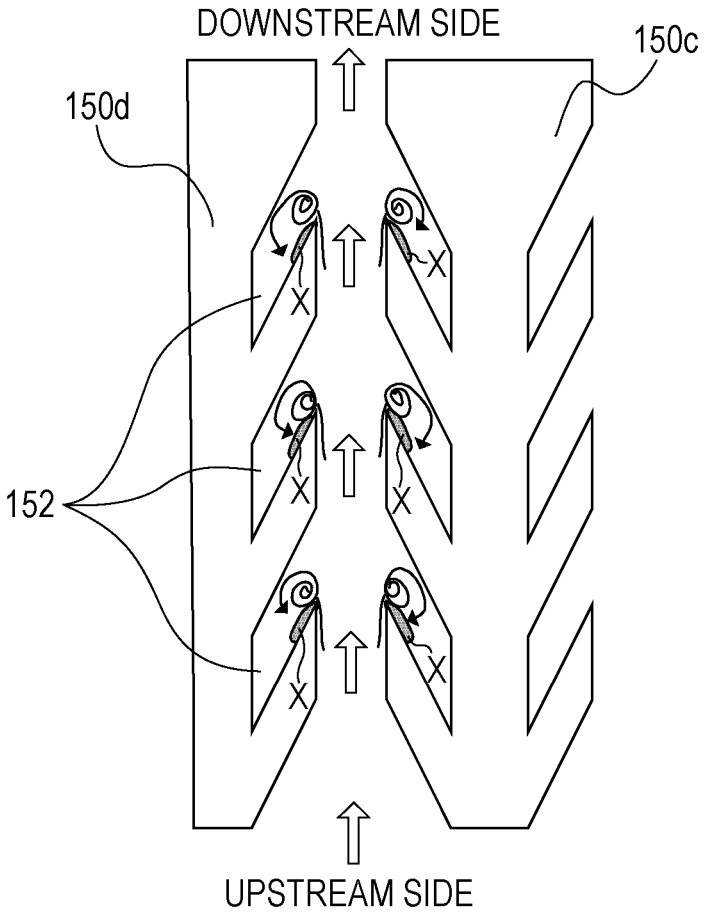
FIG. 4 is a schematic view of air currents flowing along a flow path of the particle collecting member according to the first exemplary embodiment.

FIG. 4 is a schematic view of the airflow in the flow path formed when the parts 150*c* and 150*d* of the particle collecting member 150 are caused to oppose each other. In FIG. 4, white arrows indicate a main airflow direction from the fixing roller 101. Curled arrows indicate lines of airflow into collecting chambers 152 (spaces) from the flow path formed in the particle collecting member 150.

As shown in FIG. 4, portions of the air containing vaporized particles (such as wax particles and water vapor) become vortex airflows while passing along the flow path formed in the particle collecting member 150, and flow into the collecting chambers 152. Next, a mechanism in which the line of airflow into the particle collecting chambers 152 from the flow path formed in the particle collecting member 150 will be described with reference to FIGS. 5A to 5C.

Figure 5A:
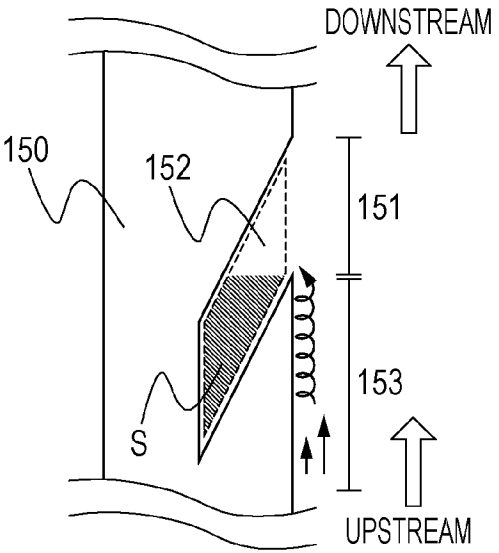
FIGS. 5A to 5C are schematic views showing features of a collecting chamber according to the first exemplary embodiment.
Figure 5B:
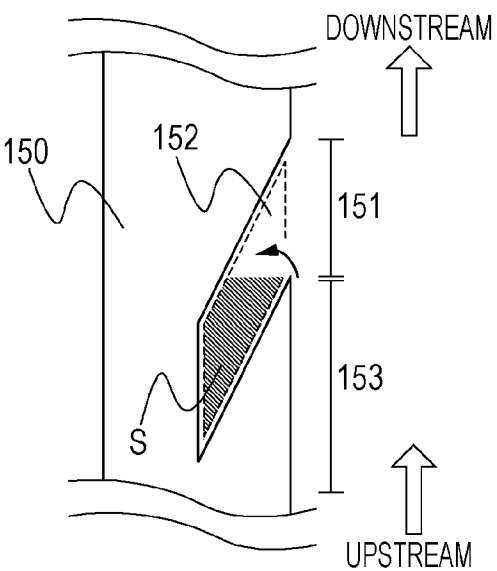
Figure 5C:
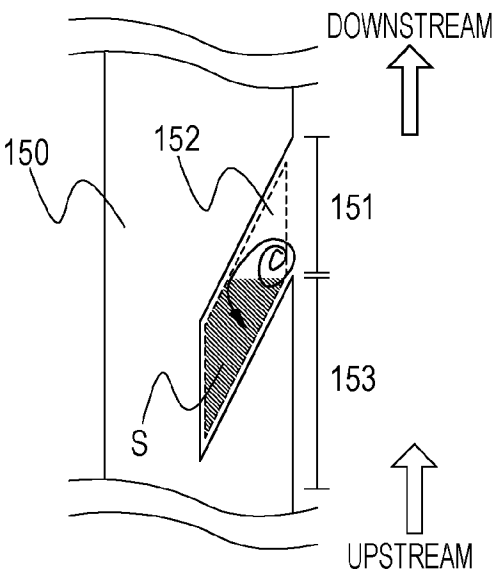

FIGS. 5A to 5C show structural features of the collecting chambers 152 according to the exemplary embodiment. The collecting chambers 152 are spaces connected to the flow path through openings 151 and having shapes that extend upstream with respect to the direction of travel of the gas passing along the flow path (that is, the direction of the white arrows). More specifically, the arrangement of the collecting chambers 152 with respect to the direction of airflow is such that the spaces S (corresponding to shaded portions in FIGS. 5A to 5C) extend upstream from the respective openings 151. That is, the hollow forms of the collecting chambers 152 provided in the particle collecting member 150 extend to ranges in which they extend upstream with respect to the airflow from the respective openings 151 (hereunder referred to as "hollow forms" or "extending upstream forms").

FIGS. 5A to 5C show the order of the airflow from the vicinity of a surface 153 of the particle collecting member 150 to the collecting chamber 152 through the opening 151.

FIG. 5A shows the behavior of air in the vicinity of the surface 153 (forming the flow path) situated at a location just outside a location where the air reaches the opening 151. In general, when a fluid, such as air, flows along a certain surface, the fluid travels while being braked by friction (generated by fluid viscosity) at a location that is very near the surface. Therefore, a travel speed of the fluid at this location is lower than a travel speed of the fluid at a location that is situated slightly away from the surface. Since there is a speed difference in a fluid layer in the vicinity of the surface 153 as indicated by short and long arrows in FIG. 5A, the fluid flows so as to form a spiral. In other words, at a location near the surface 153, the air travels while forming small vortex cores.

FIG. 5B shows the behavior of air in the vicinity of the opening 151. As mentioned above, when the air in the vicinity of the surface 153 forms vortex cores and reaches the opening 151, since the shape of a wall surface changes suddenly, the vortex cores separate from the wall surface. Then, the eddies are joined to each other and grow. At this time, angular momentum of the eddies, that is, a counterclockwise moment of the eddies acts. As a result, the air is drawn into the collecting chamber 152.

FIG. 5C shows the behavior of air in the collecting chamber 152. Whether or not a vortex motion of the eddies that are drawn into the collecting chamber 152 tends to continue largely depends upon the structure of the space of the collecting chamber 152.

As in the collecting chamber 152 shown in FIGS. 5A to 5C, when the space S is provided upstream from the opening 151, air resistance or internal pressure that acts in a direction preventing rotation of the eddies drawn into the collecting chamber is reduced. Therefore, the vortex motion in the collecting chamber 152 tends to continue, during which the air gradually loses kinetic energy and drifts.

Accordingly, the particle collecting member according to the exemplary embodiment makes use of the vortex airflows that are generated at the openings, and draws the gas passing along the flow path into the spaces, thereby causing suspended particles (vaporized components from the wax) in the gas drawn into the spaces to adhere to the walls forming the spaces. The Xs in FIG. 4 indicate the states in which the wax components in the gas drawn into the spaces adhere to the walls in the spaces.

Figure 6A:
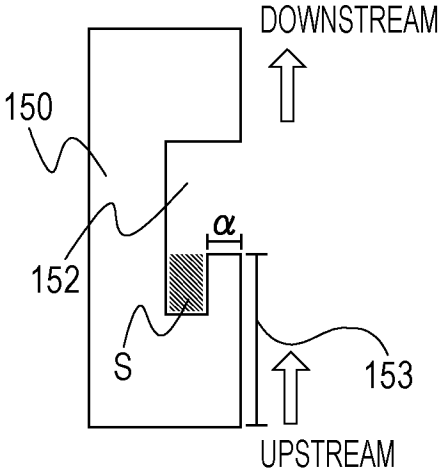
FIGS. 6A to 6C show exemplary shapes of a member that make it easy to provide operations that are similar to those according to the first exemplary embodiment.
Figure 6B:
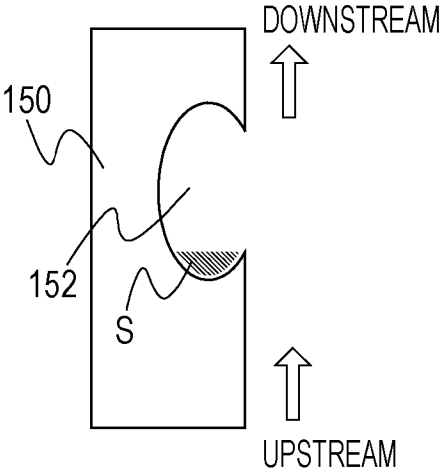
Figure 6C:
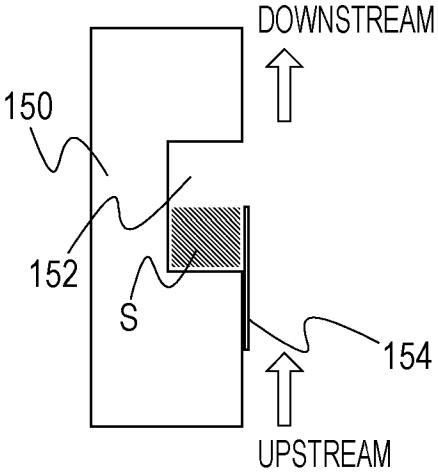

For various shapes of the member, the present inventor et al. have used wax particle groups vaporized by heating to observe airflows thereof and to study the tendency with which vortex airflows are generated. FIGS. 6A to 6C show exemplary shapes of the member that cause vortex airflows such as those described above to be generated. The shapes shown in FIGS. 6A to 6C extend over ranges in which the collecting chambers extend upstream from the respective openings, and define the aforementioned spaces S (corresponding to the shaded portions in FIGS. 6A to 6C).

More specifically, FIG. 6A shows an example in which the space S is formed at a distance (thickness) a from the one surface 153 of the particle collecting member 150. FIG. 6B shows an example in which the cross-sectional shape of the collecting chamber 152 is an arcuate shape. FIG. 6C shows an example in which the space S is formed by disposing a sheet 154 (formed of, for example, PET or polyimide) at the opening of the collecting chamber 152.

FIGS. 7A to 7E show exemplary shapes of the member that make it difficult to generate vortex airflows such as those described above. Spaces such as the above-described spaces S are not formed. The reasons why these shapes make it difficult to generate vortex airflows will be explained below. That is, in FIGS. 7A to 7C, air eddies that have reached the openings behave in the same way as in FIG. 5B until they are drawn into the collecting chamber. However, since walls oriented so as to prevent the motion of the drawn-in eddies exist near the collecting chamber, the eddies do not continue moving. They tend to merge with the main airflow again.

Figure 7A:
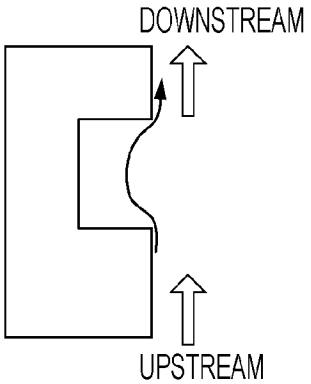
FIGS. 7A to 7E show exemplary shapes of a member that make it difficult to provide operations that are similar to those according to the first exemplary embodiment.
Figure 7B:
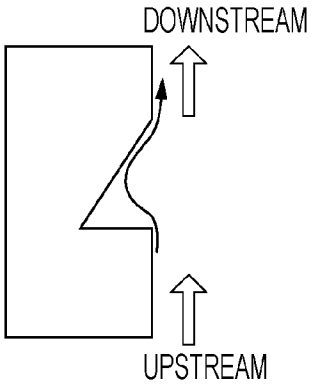
Figure 7C:
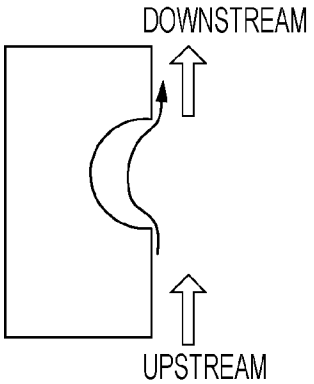
Figure 7D:
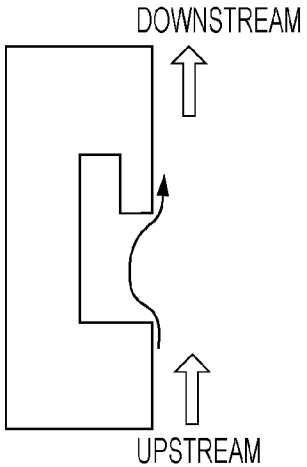
Figure 7E:
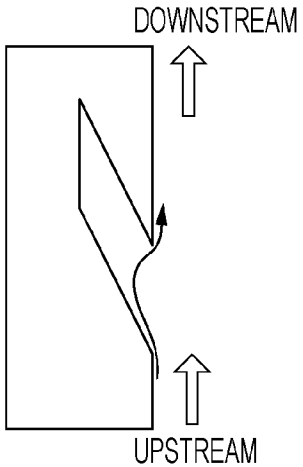

FIG. 7D shows a collecting chamber having a shape that is inverted with respect to the shape of the collecting chamber shown in FIG. 6A in an upstream-downstream direction. FIG. 7E shows a collecting chamber having a shape that is inverted with respect to the shape of the collecting chamber shown in each of FIGS. 5A to 5C in the upstream-downstream direction. The "extending upstream form" has almost no influence on the behavior of the air, and, as expected, air eddies tend to return to the main airflow.

Lastly, the reasons why the particle collecting member 150 according to the exemplary embodiment makes it easier for the wax particles to be collected, and makes it difficult for dew condensation to occur will be described. The aforementioned wax particles and water vapor flow along successive airflows. That is, these particles behave like air molecules with respect to each other. However, there is a great difference between the phase of the vaporized particles and the phase of air molecules when they flow.

The melting point of wax particles is in the range of from approximately 60° C. to 100° C. The wax particles vaporize at temperatures in a range of from 120° C. to 160° C. or greater. Therefore, although the wax particles are vaporized by the heat of the fixing roller 101, the wax particles are soon liquefied or solidified. In contrast, the water vapor is kept in a gaseous state in a range in which the quantity of water vapor does not exceed the saturated water vapor pressure near the fixing unit. In the exemplary embodiment, an airflow path is provided. Compared to the air blocking member and the filter that are described in the related art section, the airflow path does not tend to accumulate water vapor. Therefore, the amount of water vapor does not tend to become excessive. That is, the water vapor tends to be kept in a gaseous state in the exemplary embodiment.

In summary, the wax particles tend to flow in a liquid state or a solid state, whereas the water vapor tends to flow in a gaseous state. Whereas the water vapor particles in the gaseous state do not exhibit wettability and viscosity because they have weak cohesive strength, the wax particles in the liquid state or the solid state exhibit wettability and viscosity because they have cohesive strength. Therefore, although the wax particles and the water vapor behave in the same way, the ease with which they are collected by adhesion in the particle collecting member 150 differs greatly. Therefore, suspended particles in a liquid state or a solid state, such as wax particles, tend to be collected, whereas suspended particles in a gaseous state, such as water vapor particles, do not tend to be collected, so that they infrequently undergo dew condensation.

In order to make it difficult for the suspended particles (wax components) of the gas drawn into the collecting chambers 152 (the spaces S) to adhere to the inside of the walls of the collecting chambers 152 and to be vaporized again, it is desirable to design the collecting chambers 152 so that the temperature of the walls of the collecting chambers 152 is less than the vaporization temperature of the wax components.

Figure 8A:
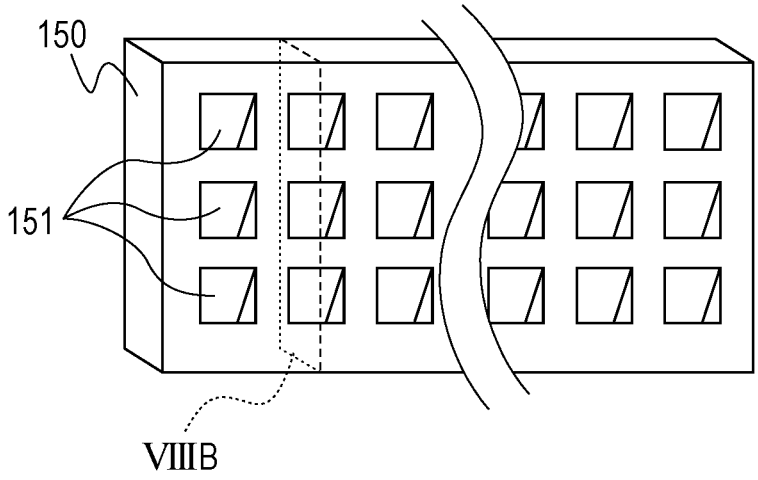
FIGS. 8A and 8B show another exemplary shape of the particle collecting member according to the first exemplary embodiment.
Figure 8B:
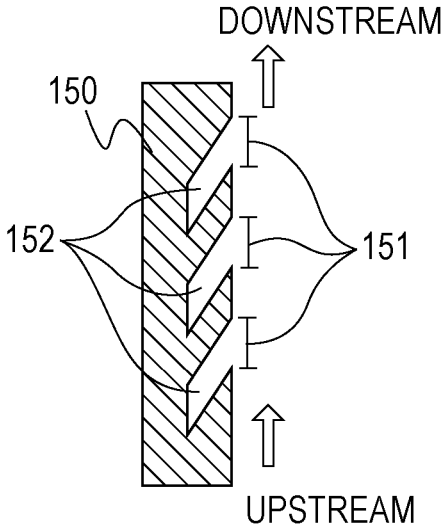

By using the particle collecting member 150 according to the exemplary embodiment, it is possible to collect suspended particles, such as wax particles, while suppressing dew condensation. Although, in the embodiment, the cross-sectional shape of the particle collecting member 150 extends in the longitudinal direction, the present invention is not limited thereto. As shown in FIGS. 8A and 8B, the cross-sectional shape of the particle collecting member 150 may have partition walls that partition the longitudinal direction. Various modifications may be made within the technical idea of the present invention.

Second Exemplary Embodiment

A fixing unit 200 according to a second exemplary embodiment uses a particle collecting member 250 that is provided in correspondence with the direction of a rotating airflow at a fixing rotating member. The other structural features are the same as those according to the first exemplary embodiment, and will not be described in detail below.

Figure 9:
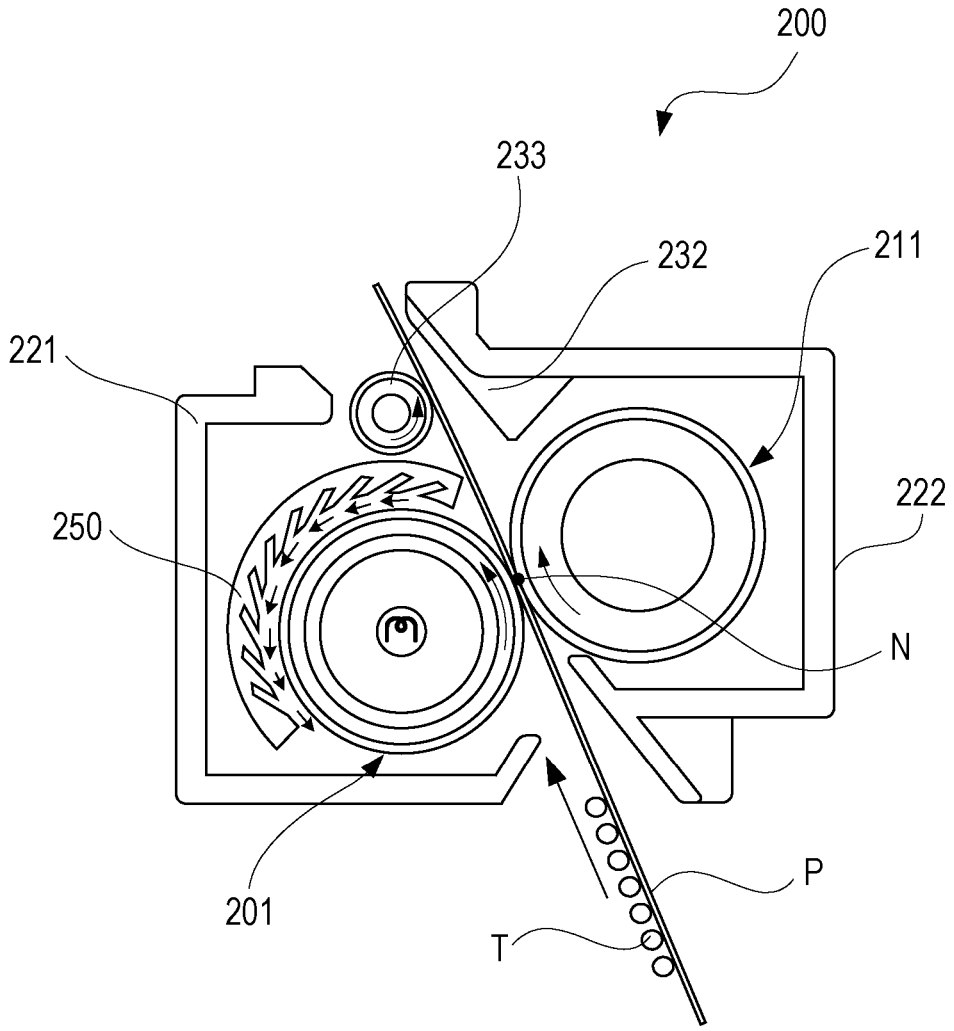
FIG. 9 is a sectional view of a fixing unit including a particle collecting member according to a second exemplary embodiment.

FIG. 9 shows the fixing unit 200 according to the second exemplary embodiment. The shape of the particle collecting member 250 follows the shape of a fixing roller 201. The particle collecting member 250 is disposed so as to surround the fixing roller 201 with a predetermined gap being provided therebetween. Hollow collecting chambers are formed in a surface of the particle collecting member 250 opposing the outer peripheral surface of the fixing roller 201. The collecting chambers are formed so as to extend upstream with respect to the rotating airflow at the fixing roller 201.

The small arrows in FIG. 9 indicate the rotating airflow at the fixing roller 201. The airflow is generated by rotation of the fixing roller 201 and by friction between the fixing roller 201 and air in the vicinity of the outer peripheral surface of the fixing roller 201. While rotating airflow along a gap (flow path) between the fixing roller 201 and the particle collecting member 250, vortex airflows are generated near openings of the collecting chambers, to collect suspended particles such as wax particles.

Here, it is desirable for the particle collecting member 250 in the second exemplary embodiment to be positioned so that the temperature of the interiors of the collecting chambers and the temperature of inner wall surfaces forming the collecting chambers are maintained at a temperature that is less than the vaporization temperature of the wax particles. This is because the particle collecting member 250 makes use of an adhesion collection method making use of the wettability and the viscosity of the suspended particles in a liquid state or a solid state.

As in the second exemplary embodiment, by introducing the technical idea of the present invention in accordance with the vaporization temperature of the suspended particles and the direction of airflow in the fixing unit, it is possible to provide advantages that are similar to those in the first exemplary embodiment. Although the particle collecting member according to the second exemplary embodiment is one that is provided in accordance with rotating airflow at the fixing roller, the present invention is not limited thereto. The present invention is applicable to a particle collecting member that is provided in accordance with airflow that is generated when a recording material P is transported and to a particle collecting member that is provided in accordance with, for example, the structure of a housing and multiple airflows at, for example, a pressure roller.

Third Exemplary Embodiment

The operational advantages according to the present invention are also achieved by the structure according to a third exemplary embodiment described below. An exemplary fixing unit 300 according to the third exemplary embodiment uses a particle collecting member of a louver type. The other structural features of the fixing unit 300 are similar to those according to the first exemplary embodiment, and will not be described in detail below.

Figure 10A:
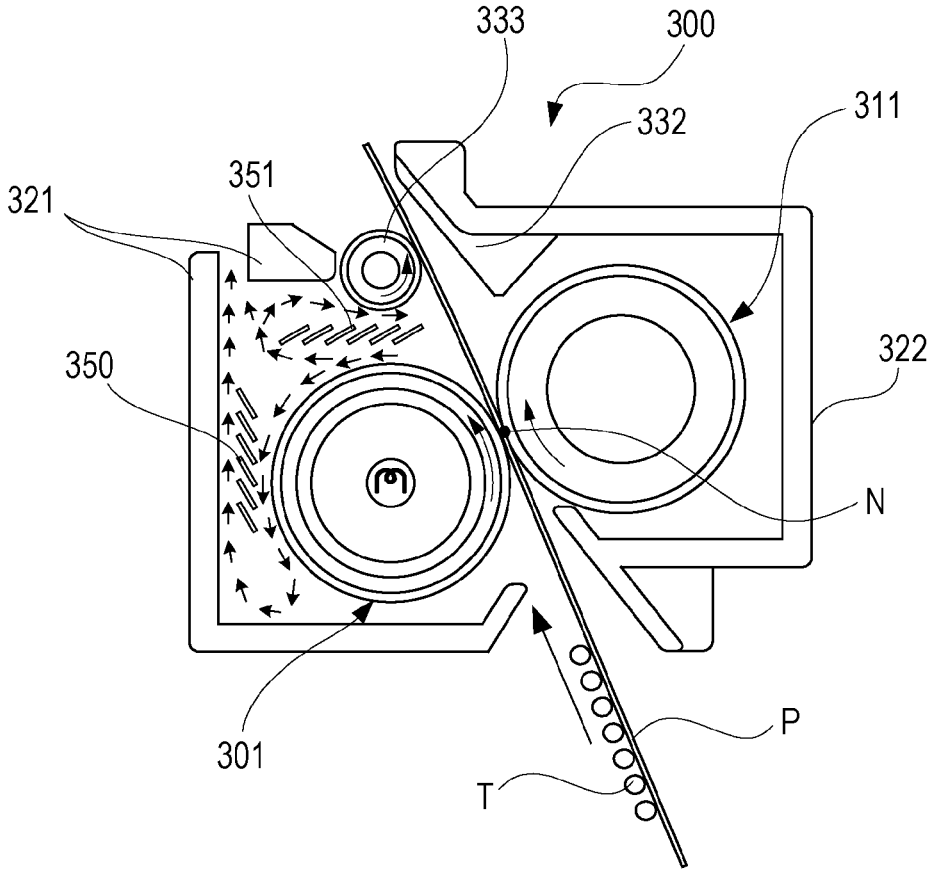
FIG. 10A is a sectional view of a fixing unit including first and second particle collecting members according to a third exemplary embodiment.
Figure 10B:
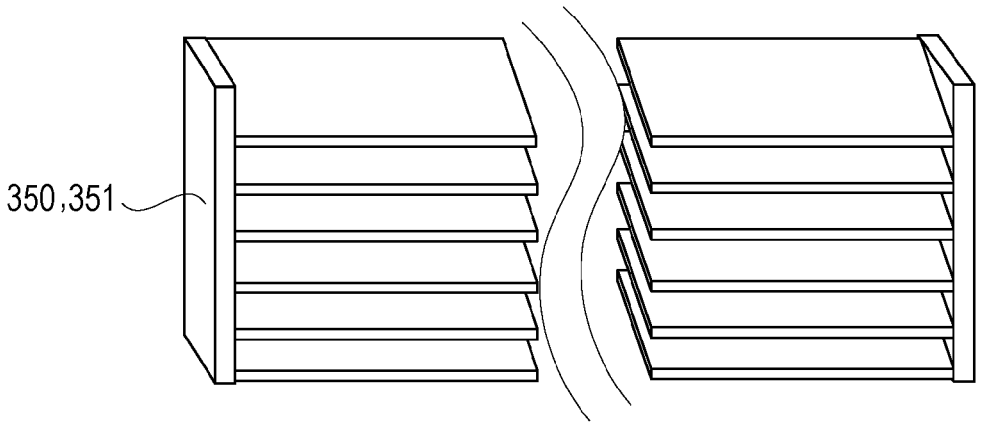
FIG. 10B is a perspective view of the first particle collecting member.

FIG. 10A shows the fixing unit 300 according to the third exemplary embodiment. FIG. 10B is a perspective view of a particle collecting member 350 (351) according to the third exemplary embodiment.

The particle collecting members 350 and 351 have the form of louver doors in which flat members that are set at a certain inclination are arranged parallel to each other (that is, the particle collecting members 350 and 351 are louvered). As in the first exemplary embodiment, the orientation of the inclination of each flat member allows formation of a space that extends upstream from a corresponding opening with respect to the direction of airflow.

The particle collecting members 350 and 351 according to the third exemplary embodiment do not have positively confined spaces serving as collecting chambers. They apparently have two openings. However, when the fixing unit 300 is being rotationally driven, a main air convection in the vicinity of a fixing roller 301 is in directions of small arrows in FIG. 10A, as a result of which airflows that positively pass between the openings do not tend to be generated. However, as regards the technical idea that suspended particles (such as wax particles) are collected by generating vortex airflows near the openings, similar operational advantages to those according to the first and second exemplary embodiments are provided.

Although, in the third exemplary embodiment, the particle collecting members 350 and 351 are louvered by inclining the flat plates, the present invention is applicable to, for example, particle collecting members including curved plates or particle collecting members including plates having different thicknesses in accordance with portions of the particle collecting members as in the wings of an airplane.

Fourth Exemplary Embodiment

The operational advantages according to the present invention are also achieved by the structure according to a fourth exemplary embodiment described below. An image forming apparatus according to the exemplary embodiment uses a particle collecting member according to the present invention in an exhaust duct 450. The other structural features of the image forming apparatus are similar to those according to the first exemplary embodiment, and will not be described in detail below.

Figure 11:
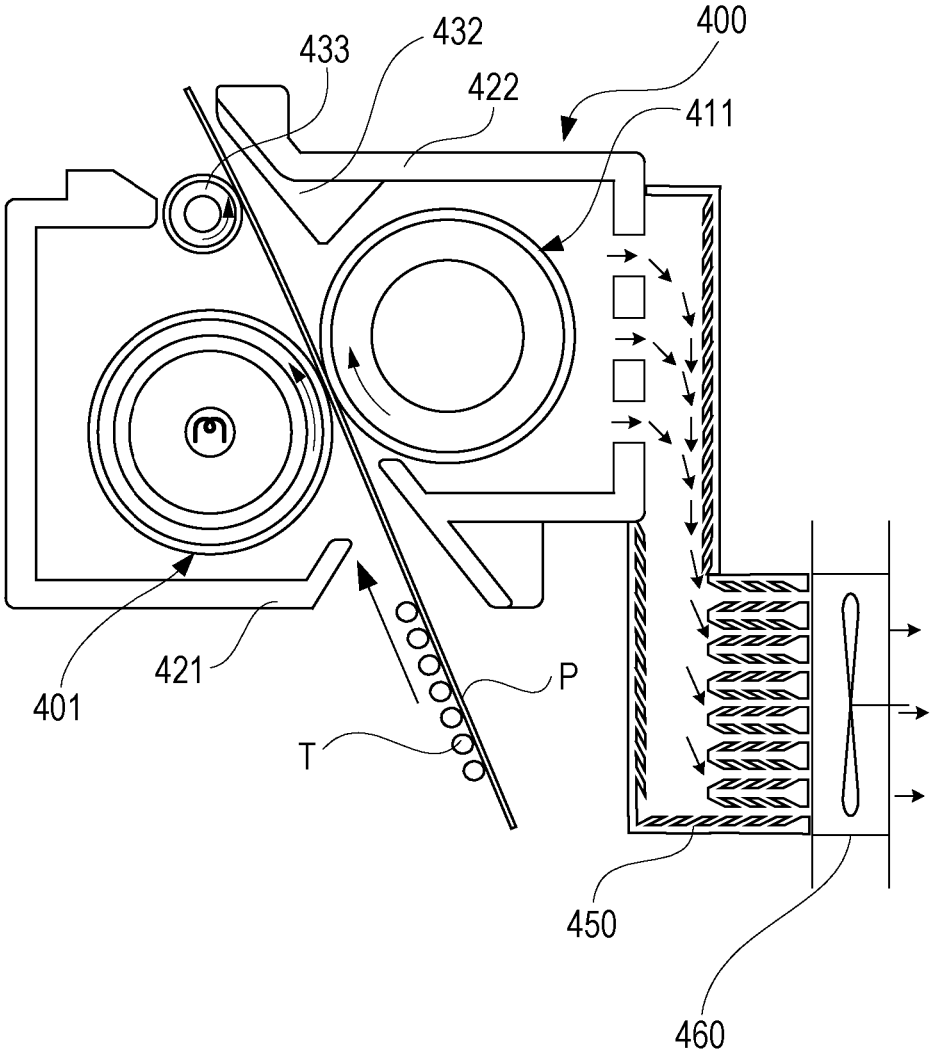
FIG. 11 is a partial sectional view of an image forming apparatus in which an exhaust duct is formed outside a fixing unit according to a fourth exemplary embodiment.

FIG. 11 is a partial sectional view of the image forming apparatus according to the fourth exemplary embodiment. In a fixing unit 400, air inlets to the exhaust duct 450 are provided at a housing 422. The exhaust duct 450 is connected to the housing 422, and discharges air out of the image forming apparatus through an exhaust fan 460. A member that is formed with a shape that is in accordance with the technical idea of the present invention is disposed at an inner wall of the exhaust duct 450 and at an inner side of the exhaust fan 460.

According to the fourth exemplary embodiment, since airflows indicated by small arrows in FIG. 11 are stably generated in the exhaust duct 450 by driving the exhaust fan 460, the probability with which suspended particles (such as wax particles) leak to the outside through other paths is low.

Although, in the exemplary embodiment, the exhaust duct 450 is provided at a portion of the housing 422 at a side of a pressure roller 411, the present invention is not limited. The exhaust duct 450 may be disposed at various other locations that are in accordance with the technical idea of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-269737 filed Dec. 2, 2010, which is hereby incorporated by reference herein in its entirety.

What is claimed is:

1. An image forming apparatus comprising:

an image forming section configured to form a toner image on a recording material using toner containing wax;

a fixing section configured to fix the toner image to the recording material by heating the toner image; and a suspended particle collecting member configured to collect suspended particles that are components generated from the wax when the toner is heated at the fixing section, the suspended particle collecting member having a flow path, an opening, and a space, where gas containing the suspended particles passes along the flow path, the opening being provided in the flow path, the space being connected to the flow path through the opening, extending upstream with respect to a direction of travel of the gas that passes along the flow path, and being formed by a wall.

2. The image forming apparatus according to claim 1, wherein the suspended particle collecting member makes use of vortex airflow to draw the gas that passes along the flow path into the space, so that the suspended particles in the gas drawn into the space adhere to the wall forming the space, the vortex airflow being generated at the opening.

3. The image forming apparatus according to claim 1, wherein the wall forming the space is maintained at a temperature that is less than a vaporization temperature of the suspended particles.

4. The image forming apparatus according to claim 1, wherein the suspended particle collecting member is provided in the fixing section.

5. The image forming apparatus according to claim 1, wherein the suspended particle collecting member is disposed so as to follow a shape of a fixing rotating member in the fixing section.

6. A suspended particle collecting member comprising:

a flow path along which gas containing suspended particles pass;

an opening that is formed in the flow path; and a space that is connected to the flow path through the opening, the space extending upstream with respect to a direction of travel of the gas that passes along the flow path, the space being formed by a wall.

7. The suspended particle collecting member according to claim 6, wherein the suspended particle collecting member makes use of vortex airflow to draw the gas that passes along the flow path into the space, so that the suspended particles in the gas drawn into the space adhere to the wall forming the space, the vortex airflow being generated at the opening.

* * * * *